US009919538B2

(12) United States Patent
Mark et al.

(10) Patent No.: US 9,919,538 B2
(45) Date of Patent: Mar. 20, 2018

(54) CORRUGATED-BOARD MACHINE

(71) Applicant: BHS Corrugated Maschinen-und Anlagenbau GmbH, Weiherhammer (DE)

(72) Inventors: Maximilian Mark, Tirschenreuth (DE); Gerhard Grünwald, Freudenberg (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 15/272,803

(22) Filed: Sep. 22, 2016

(65) Prior Publication Data

US 2017/0087878 A1 Mar. 30, 2017

(30) Foreign Application Priority Data

Sep. 24, 2015 (DE) ..... 10 2015 218 316

(51) Int. Cl.
*B41J 11/00* (2006.01)
*B31F 1/28* (2006.01)
(Continued)

(52) U.S. Cl.
CPC ..... *B41J 11/0015* (2013.01); *B31F 1/285* (2013.01); *B31F 1/2822* (2013.01); *B41F 17/00* (2013.01);
(Continued)

(58) Field of Classification Search
CPC ..... B31F 1/20; B31F 1/2813; B31F 1/285; B31F 1/2822; B31F 1/36; B31F 2201/0792; B31F 5/00
(Continued)

(56) References Cited

U.S. PATENT DOCUMENTS 5,259,124 A * 11/1993 Poterala ..... F26B 13/10 34/242
5,772,819 A 6/1998 Olvey
(Continued)

FOREIGN PATENT DOCUMENTS

DE 198 57 370 A1 6/2000
DE 200 06 483 U1 7/2000
(Continued)

*Primary Examiner* — Huan Tran
*Assistant Examiner* — Alexander D Shenderov
(74) *Attorney, Agent, or Firm* — McGlew and Tuttle, P.C.

(57) ABSTRACT

A corrugated-board machine for manufacturing corrugated board comprises a material-web output device for outputting a material web, a conveying device for conveying the material web along a material-web conveying path, a printing device disposed downstream of the material-web output device for producing at least one printed region on the material web, a printed-region drying arrangement disposed downstream of the printing device for drying the at least one printed region and a connecting device disposed downstream of the printed-region drying arrangement for the connection of the printed material web to at least one further material web in order to produce a printed corrugated-board web laminated on at least one side. A start of drying of the at least one printed region applied to the material web is influenceable by the printed-region drying arrangement.

21 Claims, 9 Drawing Sheets

(51) Int. Cl.

| | |
|---|---|
| ***B41F 33/00*** | (2006.01) |
| ***B41F 33/16*** | (2006.01) |
| ***B41F 17/00*** | (2006.01) |
| ***B41F 23/04*** | (2006.01) |

(52) U.S. Cl.
CPC ..... *B41F 23/04* (2013.01); *B41F 33/0009* (2013.01); *B41F 33/16* (2013.01)

(58) Field of Classification Search
USPC ..... 347/102
See application file for complete search history.

(56) References Cited

U.S. PATENT DOCUMENTS

| | | | | |
|---|---|---|---|---|
| 5,847,362 | A * | 12/1998 | Sissons | B31F 1/285 156/210 |
| 2006/0148631 | A1* | 7/2006 | Protocsnak | B31F 1/2822 493/463 |
| 2012/0024476 | A1* | 2/2012 | Ohira | B31F 1/2809 156/322 |
| 2012/0064657 | A1* | 3/2012 | Pepler | C23C 14/26 438/61 |
| 2015/0101740 | A1 | 4/2015 | Morales Garcia de la Vega et al. | |

FOREIGN PATENT DOCUMENTS

| | | | |
|---|---|---|---|
| EP | 1 980 389 | A1 | 10/2008 |
| EP | 2 712 734 | A1 | 4/2014 |
| WO | 2007/050202 | A2 | 5/2007 |
| WO | 2013/187775 | A1 | 12/2013 |

* cited by examiner

CORRUGATED-BOARD MACHINE

CROSS-REFERENCE TO RELATED APPLICATIONS

This application claims the priority of German Patent Application Serial No. DE 10 2015 218 316.5 filed on Sep. 24, 2015, pursuant to 35 U.S.C. (a)-(d), the content of which is incorporated herein by reference in its entirety as if fully set forth herein.

FIELD OF THE INVENTION

The invention relates to a corrugated-board machine and a method for manufacturing corrugated board.

BACKGROUND OF THE INVENTION

The printing of corrugated board or respectively its material webs is generally known. Especially in the case of untreated material webs for manufacturing corrugated board, the colour acceptance or respectively colour absorption processes generally require extreme lengths of time. In the case of rapid drying or respectively excessively fast conveying speeds, patchy printed regions or respectively printed images frequently occur. By contrast, with treated material webs for manufacturing corrugated board, a rapid drying is often advantageous in order to prevent the formation of droplet merging.

SUMMARY OF THE INVENTION

The invention is based upon the object of providing a corrugated-board machine which overcomes the disadvantages specified above. In particular, a corrugated-board machine should be provided, with which an extremely good print quality can be achieved and extremely diverse material webs can be printed. Furthermore, the printed regions produced by the printing during the corrugated-board manufacture should be of consistent quality. The printing should be capable of implementation in an extremely economical manner. Furthermore, a corresponding method should be provided.

This object is achieved according to the invention by a corrugated-board unit for manufacturing corrugated board, comprising a material-web output device for outputting a material web, a conveying device for conveying the material web along a material-web conveying path, a printing device, disposed downstream of the material-web output device, for producing at least one printed region on the material web, a printed-region drying arrangement, disposed downstream of the printing device, for drying the at least one printed region, and a connecting device, disposed downstream of the printed-region drying arrangement, for connecting the printed, dried material web to at least one further material web to produce a printed corrugated web, wherein a start of drying of the at least one printed region applied to the material web is influenceable by the printed-region drying arrangement. Furthermore, this object is achieved according to the invention by a method for manufacturing corrugated board, comprising the following steps: output of a material web from a material-web output device, production of at least one printed region on the material web by means of a printing device, drying of the at least one printed region by a printed-region drying arrangement, influencing a start of drying of the at least one printed region applied to the material web by the printed-region drying arrangement, and connecting the printed and dried material web to at least one further material web in a connecting device in order to produce a printed corrugated-board web. The core of the invention is that a start time of the active drying or respectively a drying idle-time, that is, a period of time without active drying, is influenceable or respectively variable in time by the printed-region drying arrangement of the at least one printed region applied to the material web or respectively of the material web. This has an influence on the printed region progression time or respectively the progression time of the at least one printed region. In particular, the printing and/or drying takes place in the case of a conveyed material web.

Up to the start of drying the at least one printed region applied to the material web through the printed-region drying arrangement, the at least one printed region preferably remains substantially uninfluenced with regard to drying.

In particular, the start of drying of the at least one printed region applied to the material web through the printed-region drying arrangement is influenceable by varying a distance between the printing device and the printed-region drying arrangement and/or by varying a partial conveying path travelled by the material web between the printing device and the printed-region drying arrangement and/or by varying a drying power of the printed-region drying arrangement.

The printed-region drying arrangement is favourably arranged upstream of the connecting device.

It is advantageous if the first material-web output device comprises at least one material-web roller. The first material-web output device is favourably constituted as a splicing device.

It is expedient if the printing device is constituted as a digital-printing device. Other known printing devices can be used as an alternative.

The at least one printed region or respectively print is preferably water-based. The at least one printed region is favourably formed by at least one colour or respectively ink and is therefore monochrome or multicoloured. This comprises, for example, at least one letter, number, other character, a graphic and/or a photograph. The at least one printed region favourably has at least one printed motif. The at least one printed region covers at least one two-dimensional region of the material web. It is favourable if the at least one printed region is visible from the outside on the finished corrugated-board (web). The printed material web is preferably an external laminated web or cover-web in the finished corrugated-board (web). Alternatively, the material web to be printed is multi-layered.

According to one preferred embodiment, the corrugated-board web is therefore printed and dried externally on both sides. In a favourable manner, the material web and/or the at least one further material web is endless. The at least one further material web is preferably multilayered. It is preferably a corrugated-board web with at least one corrugated web and at least one cover-web.

The connecting device is preferably constituted as a gluing device for the gluing of the printed material web and at least one further material web.

The finished corrugated-board web is favourably a three-layered or five-layered corrugated-board web.

The expression "downstream" as used here relates especially to the conveying direction of the respective web. This applies by analogy for similar terms.

The embodiment in which an information processing device varies the start of drying of the at least one printed region applied to the material web dependent upon a material-web conveying speed of the material web allows substantially consistent printing results or respectively a consistent printing quality in the case of different or respectively variable material-web conveying speed of the printed or respectively to-be-printed material web. A variable material-web conveying speed of this material web can be compensated particularly well in this manner. A colour acceptance can therefore be stabilised extremely well with different material-web conveying speeds.

For example, with comparatively fast material-web conveying speeds of the printed material web, a delayed drying of the material web takes place for the time compensation through the printed-region drying arrangement. For example, with comparatively slow material-web conveying speeds of the printed material web, an accelerated drying of the material web takes place for the time compensation through the printed-region drying arrangement.

The information processing device is favourably an electronic information processing device.

It is advantageous if the printed-region drying arrangement is displaceable at least partially along the material-web conveying path of the material web in order to influence the start of drying of the at least one printed region. This embodiment is particularly functionally secure and simple. The printed-region drying arrangement is displaceable, for example, in its entirety or in part. By preference, at least one corresponding displacement device, such as a motor, actuator, piston-cylinder unit or similar is present for this purpose. In particular, a variation of the material-web intermediate conveying path takes place via the material-web conveying speed.

The embodiment in which a drying power of the printed-region drying arrangement is variable in order to influence the start of drying of the at least one printed region again allows a particularly simple and functionally secure influencing of the start of drying of the at least one printed region.

In particular, the first drying device of the printed-region drying arrangement, which is especially a pre-drying device, for at least partially drying the at least one printed region on the material web, wherein the first drying device comprises at least one first drying unit, is constituted to extract at least a majority of the contained water from the at least one printed region. By preference, the first drying device heats the printed material web and/or the at least one printed region applied to the latter, preferably to 60° C. to 120° C. for this purpose. A thermal drying and therefore an at least partial dehumidification of the at least one printed region favourably takes place. In particular, the viscosity of the at least one printed region or respectively the colour viscosity increases in this context. For example, an excessive tonal value increase or an excessive dot gain or respectively an excessive blotting of the at least one colour in the at least one printed region can be effectively prevented in this manner. In particular, the at least one first drying unit extends perpendicular to the conveying direction of the printed material web extending adjacently. The first drying device is favourably displaceable relative to the printing device in order to influence the start of drying, wherein the first drying device is preferably displaceable along the printed material web.

It is advantageous if the first drying unit is constituted as a spotlight device, especially an infrared spotlight device.

The first drying device, which comprises several of the first drying units for drying the at least one printed region has a particularly high drying power. The first drying units are disposed downstream of one another with reference to a conveying direction of the printed material web.

The first drying device in which the first drying units are connected to one another in a hinged manner for arrangement adjacent to the material web is particularly flexible and is, for example, extremely readily capable of following the progression of the printed material web, especially in the case of its displacement.

In one embodiment, a variation of a drying power of at least one first drying unit arranged upstream leads to a compensation by at least one succeeding drying unit; for example, a reduction of the drying power of at least one first drying unit arranged upstream leads to a corresponding increase of the drying power of the first drying unit(s) downstream of the former. By preference, the overall drying power of the first drying device remains constant.

In addition to the physical displacement of the first drying units, which favourably takes place especially in discrete steps, or, as an alternative to this, a fine adjustment of a printed-region progression time through displacement or respectively at least partial transfer of the drying power between the individual first drying units is also possible for this purpose. For example, by increasing outputting at least one first drying unit and through simultaneous reduction of outputting at least one further first drying unit, which comprises a smaller conveying distance relative to the printing device, with reference to the first drying unit of increased output, the printed-region progression time is lengthened. This preferably takes place with comparatively fast material-web conveying speeds. By contrast, the exactly reversed displacement or respectively at least partial transfer of the drying power allows a shortening of the printed-region progression time. By preference, the overall drying equation of the first drying device remains constant.

In the embodiments in which a variation of a drying power of at least one first drying unit arranged upstream leads to a compensation by at least one succeeding drying unit, in which a reduction of a drying power of at least one first drying unit arranged upstream leads to an increase of the drying power of the at least one first drying unit disposed downstream of the former, in which a fine adjustment of the printed-region progression time is possible through at least partial transfer of a drying power between the individual first drying units, in which an increase of an output of at least one first drying unit and simultaneous reduction of an output of at least one further first drying unit, which, with reference to the first drying unit of increased output, comprises a reduced conveying distance relative to the printing device, leads to a shortening of a printed-region progression time, and in which an increase of a drying power of the first drying unit arranged adjacent to an entrance of the printed-region drying arrangement takes place when the material web is conveyed with comparatively reduced material-web conveying speed, a displacement of the drying power of the first drying device takes place within the same or respectively between the first drying units in order to influence the start of drying or respectively the variation of a printed-region progression time.

The drying power is displaceable between a first drying unit arranged upstream and downstream, in each case with reference to the conveying direction of the material web to be dried. In particular, it is displaceable along the material-web conveying path within the printed-region drying arrangement.

By preference, in the embodiment in which an increase of a drying power of the first drying unit arranged adjacent to an entrance of the printed-region drying arrangement takes place when the material web is conveyed with comparatively reduced material-web conveying speed, in the case of a declining material-web conveying speed, the drying power of the first drying unit(s) arranged downstream is displaced, in particular, successively, to the at least one first drying unit arranged upstream of it, which has a shorter conveying distance relative to the printing device, by comparison with the first drying unit/s with reduced drying power.

In one embodiment, temperature measuring sensors are associated to the first drying units for measuring the temperature predominating there at the material web. Favourably, the temperature measuring sensors measure substantially the temperature of the material web between the first drying units. To this end, the first drying units are for instance arranged at the inlet side and/or at the outlet side of the first drying units. Favourably, the temperature measuring sensors measure the temperature on an upper side of the material web.

The embodiment in which the information-processing device receives temperature signals from the temperature measurement sensors and activates at least one of the first drying units or the first drying device in its entirety correspondingly allows a particularly effective or respectively error-free displacement of the drying power of the first drying units. In particular, a non-linearity between power input and heating of the material web can be taken into account and respectively compensated in this manner. In particular, a follow-on control is therefore possible.

It is expedient if a material-web intermediate conveying path of the material web present between the printing device and the first drying device is variable in its length in order to influence the start of drying of the at least one printed region. This embodiment leads to a particularly effective influencing of the start of drying of the at least one printed region applied to the material web by varying the effective length of the material-web intermediate conveying path. For this purpose, the printing device and/or the first drying device are preferably at least partially displaceable relative to one another. Alternatively or additionally, the length of the material-web intermediate conveying path is influenceable through displacement of at least one deflection roller deflecting the printed-material web and/or through variation of at least one freely suspended web loop of the printed material web.

It is advantageous if a cooling takes place between the first drying units through free running of the material web, that is, in a favourable manner, without cover of the material web, and/or through active ventilation with air.

The second drying device arranged downstream of the first drying device for at least partially drying the at least one printed region on the material web, said second drying device comprising at least one second drying unit which differs from the at least one first drying unit in its manner of functioning, is favourably capable of achieving a complete or respectively almost complete drying of the at least one printed region, especially through convection of the ambient air applied.

It is expedient if the second drying device is steam-heated or gas-fired. In particular, the second drying device is capable of extracting residual liquid printing components or respectively ink components from the at least one printed region. Downstream of the second drying device, a print-side deflection of the printed material web is favourably possible, without this leading to an impairment of the at least one printed region.

It is advantageous if the at least one second drying unit is constituted as a hot-air drying unit.

Several of the second drying units are favourably present, wherein the second drying units are arranged adjacent to one another along the material-web conveying path. This embodiment leads to a second drying device which has an extremely high drying power. The second drying units are disposed downstream of one another with reference to a conveying direction of the printed material web.

The at least one guiding device for guiding the material web, said guiding device preferably comprising a first guiding unit inclined relative to a horizontal, favourably prevents a distortion of the printed material web. A free suspension of the printed material web can therefore be favourably avoided in a particularly effective manner.

It is advantageous if the first guiding unit guides the printed material web in its conveying direction from top to bottom.

It is advantageous if the first guiding unit extends in a curved manner at least in regions and/or has guide regions inclined towards one another. This embodiment leads to a particularly effective guiding of the printed material web. In particular, through the first drying units connected to one another in a hinged manner, the first drying device is able to follow the printed material web as it is displaced, in a sense, while retaining the distance from the latter, which leads to a particularly effective, stable, uniform drying.

By preference, the guiding device comprises at least one guide roller, wherein the at least one guide roller can preferably be driven and/or braked in order to influence the tension of the material web. Through the at least one guide roller, the web tension of the printed-material web is influenceable in a particularly effective manner, so that a free suspension of the same can be minimised or respectively prevented.

It is advantageous if several guide rollers are present in the printed-region drying arrangement. At least one support element, such as a support plate for the support of the printed material web, is favourably arranged between adjacent guide rollers.

It is expedient if a corona pre-treatment device is present upstream of the printing device for the pre-treatment of the material web to be printed. This embodiment achieves a particularly good printing quality. In this context, the surface energy of the material web to be printed is influenced in a known manner by a corona pre-treatment. Initially, this leads, especially to higher dot gains and to a homogenisation in two-dimensional print image elements, wherein, in particular, both disturbing structural effects in the printed image and also longitudinal stripes can be efficiently reduced through the possibility of a faster drying, in combination with a variable start of drying.

According to the invention, it has been recognised that the start of drying of the at least one printed region applied to the material web is influenceable, for example, through at least partial, physical displacement of the printed-region drying arrangement and/or through at least partial displacement of the electrical drying power of the printed-region drying arrangement.

In the following, preferred embodiments of the invention are described by way of example with reference to the attached drawings.

DESCRIPTION OF THE PREFERRED EMBODIMENTS

Figure 1:
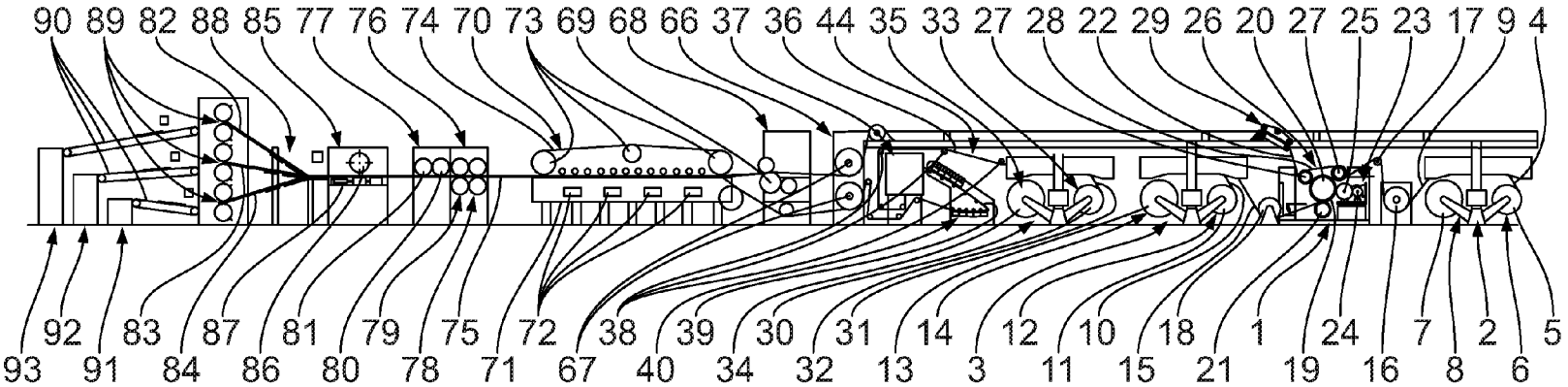
FIG. 1 shows a schematic lateral view of a corrugated-board machine according to the invention.

Initially, a corrugated-board machine as shown in FIG. 1 comprises an arrangement for manufacturing an endless corrugated-board web laminated on one side.

A first splicing device 2 and a second splicing device 3 are arranged upstream of the arrangement 1 for manufacturing an endless corrugated-board web laminated on one side.

The first splicing device 2 comprises a first unrolling unit 6 for the unrolling of an open-ended first material web 4 from a first material-web roller 5 and a second unrolling unit 8 for the unrolling of an open-ended second material web from a second material-web roller 7. The open-ended first material web 4 and second material web are connected to one another in order to provide an endless first material web 9 by means of a connecting and cutting unit of the first splicing device 2 which is not illustrated.

The second splicing device 3 is constituted to correspond to the first splicing device 2. This comprises a third unrolling unit 12 for the unrolling of an open-ended third material web 10 from a third material-web roller 11 and a fourth unrolling unit 14 for the unrolling of an open-ended second material web from a fourth material-web roller 13. The open-ended third material web 10 and fourth material web are connected to one another in order to provide an endless second material web 15 by means of a connecting and cutting unit of the second splicing device 3 which is not illustrated.

The endless first material web 9 is supplied via a heating roller 16 and a first deflection roller 17 to the arrangement 1 for manufacturing an endless corrugated-board web laminated on one side, while the endless second material web 15 is supplied via a second deflection roller 18 to the arrangement 1 for manufacturing an endless corrugated-board web laminated on one side.

In order to produce an endless corrugated web 19 comprising a corrugation from the endless second material web 15, the arrangement 1 for manufacturing an endless corrugated-board web laminated on one side comprises a first corrugating roller 20 mounted in a rotatable manner and a second corrugating roller 21 mounted in a rotatable manner. The corrugating rollers 20, 21 form a roller gap for the passage and corrugation of the endless second material web 15, wherein axes of rotation of the two corrugating rollers 20, 21 extend parallel to one another. Together, the corrugating rollers 20, 21 form a corrugating unit.

In order to connect the endless corrugated web 19 to the first endless material web 9 to form a corrugated-board web 22 laminated on one side, the arrangement 1 for manufacturing an endless corrugated-board web laminated on one side comprises a glue-application unit 23, which comprises a glue-dosage roller 24, a glue container (not illustrated) and a glue-application roller 25. For the passage and gluing of the endless corrugated web 19, the glue-application roller 25 forms a gap with the first corrugating roller 20. The glue disposed in the glue container is applied via the glue-application roller 24 to tips of the corrugation of the endless corrugated web 19. The glue-dosage roller 24 is disposed in contact with the glue-application roller 25 and serves for the formation of a uniform glue layer on the glue-application roller 25.

The endless first material web 9 is then fitted together with the endless corrugated web 19 provided with glue from the glue container in the arrangement 1 for manufacturing an endless corrugated-board web 22 laminated on one side.

In order to press the endless first material web 9 against the endless corrugated web 19 provided with glue, which, in turn, is in contact in regions with the first corrugating roller 20, the arrangement 1 for manufacturing an endless corrugated-board web has a pressing module 26. The pressing module 26 is favourably embodied as a pressing-belt module. It is arranged above the first corrugating roller 20. The pressing module 26 has two deflection rollers 27 and an endless pressing belt 28, which is guided around the deflection rollers 27. The first corrugating roller 20 engages in regions in a space present between the deflection rollers 27, so that the pressing belt 28 is deflected by the first corrugating roller 20. The pressing belt 28 presses against the endless first material web 9, which is pressed in turn against the endless corrugated web 19 provided with glue, in contact with the first corrugating roller 20.

For the intermediate storage and buffering of the endless corrugated-board web 22 laminated on one side, this is supplied to a storage unit 29, where the latter forms loops.

Furthermore, the corrugated-board machine has a third splicing device 30, which comprises a fifth unrolling unit 33 for the unrolling of an open-ended fifth material web 31 from a fifth material-web roller 32, and a sixth unrolling unit 35 for the unrolling of an open-ended sixth material web from a sixth material-web roller 34. The open-ended fifth material web 31 and sixth material web are connected to one another in order to provide an endless third material web 36 by means of a connecting and cutting unit of the third splicing device 30 which is not illustrated. The endless third material web 36 forms an outer cover-web on the finished corrugated-board web to be produced.

The endless third material web 36 is conveyed by means of a conveying device along a material-web conveying path 44 in a conveying direction 48. The conveying device is formed, for example, through at least one roll, roller, a belt arrangement or similar.

With reference to the conveying direction 48 of the endless third material web 36, a digital printing device 37 is arranged downstream of the third splicing device 30. The endless third material web 36 is supplied via deflection rollers 38 to the digital printing device 37. In the digital printing device 37, the endless third material web 36 is printed on its outer side 39, thereby forming at least one printed region, which also subsequently forms an outer side of the corrugated-board web to be produced or respectively the finished product.

Figure 2:
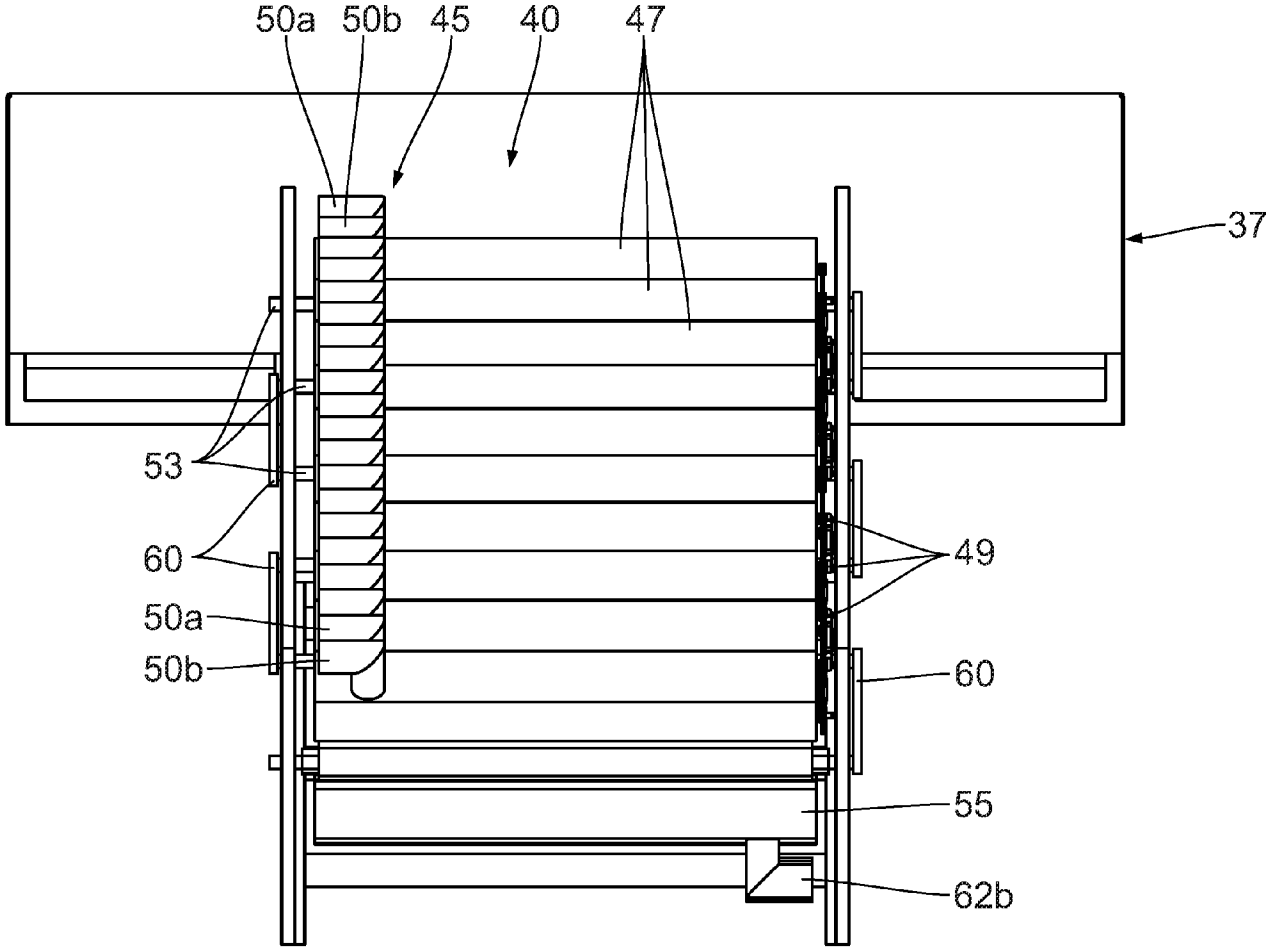
FIG. 2 shows a plan view of the printing device and the printed-region drying arrangement of the corrugated-board machine illustrated in FIG. 1.
Figure 3:
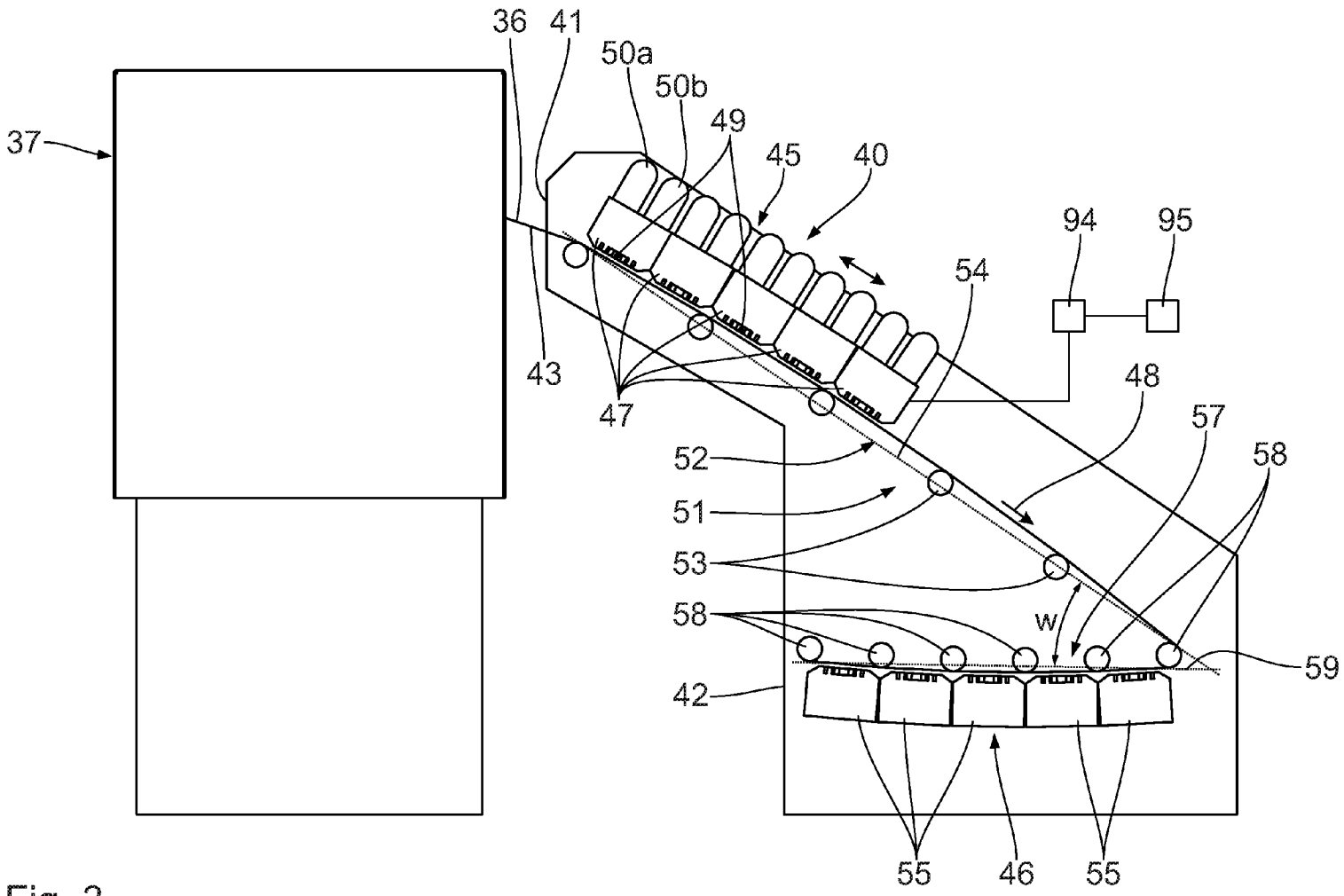
FIG. 3 shows a lateral view of the arrangement of printing device and printed-region drying arrangement illustrated in FIG. 2, wherein a first drying device of the printed-region drying arrangement is disposed in a first end position.
Figure 4:
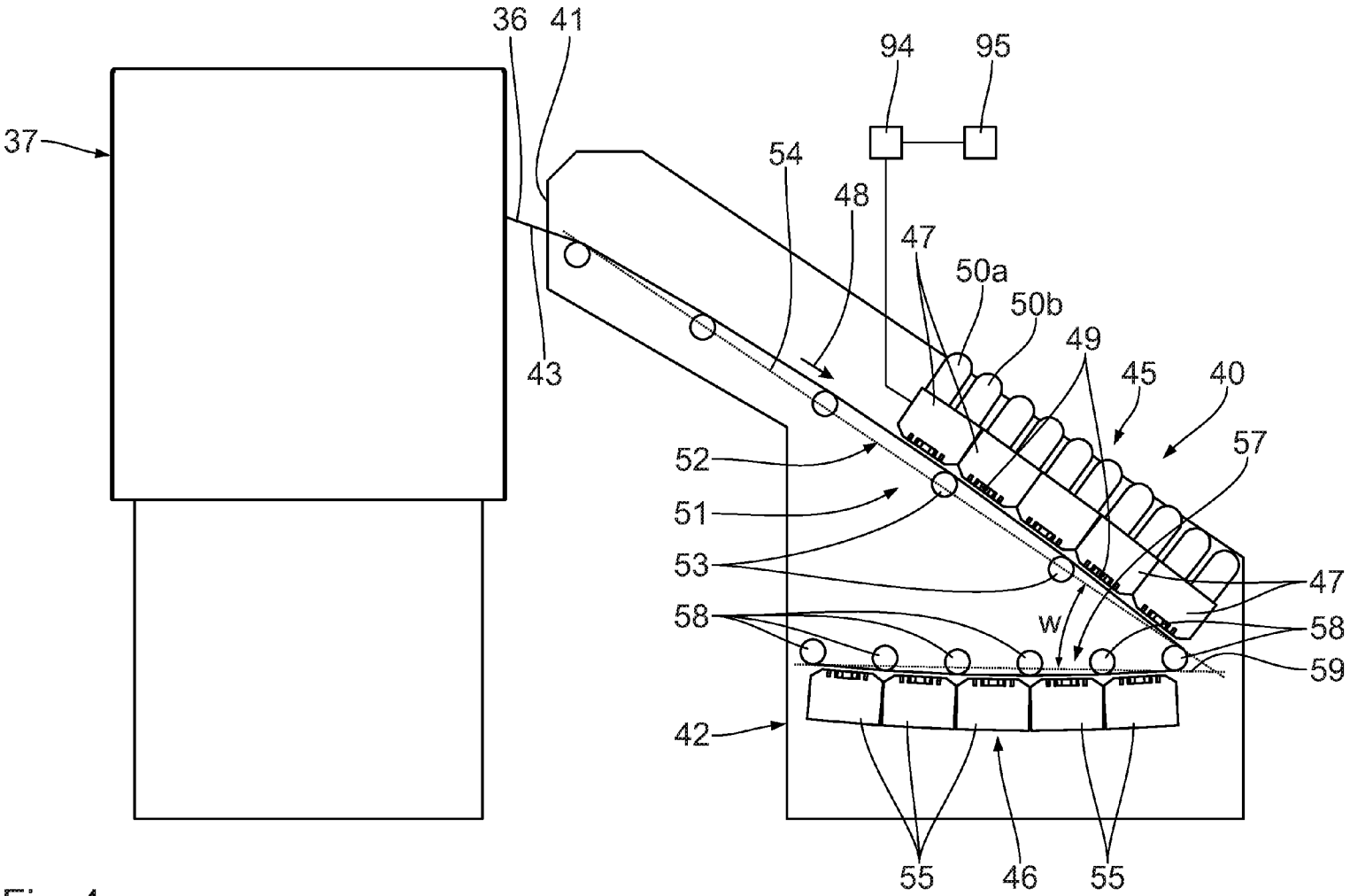
FIG. 4 shows the arrangement illustrated in FIG. 3, wherein the first drying device is disposed in a second end position

With reference to the conveying direction 48 of the endless third material web 36, a printed-region drying arrangement 40 is arranged downstream of the digital printing device 37, which is illustrated in detail in FIGS. 2 to 4. The printed-region drying arrangement 40 is arranged adjacent to the digital printing device 37. The endless third material web 36 printed on the outer side 39 is supplied to the printed-region drying arrangement 40 in order to dry its at least one printed region.

The printed-region drying arrangement 40 has an input 41 and output 42, which is arranged downstream of the input 41.

The printed-region drying arrangement 40 comprises a pre-drying device 45 arranged adjacent to the input 41 and a drying device 46 arranged downstream of the pre-drying device 45.

Between the pre-drying device 45 and the digital printing device 37, a material-web intermediate conveying path 43 is present, which is part of a material-web conveying path 44 of the endless third material web 36.

The pre-drying device 45 comprises several, favourably between two and 10, preferably between three and seven, pre-drying units 47, which extend perpendicular to the conveying direction 48 of the adjacent endless third material web 36 and are arranged adjacent to one another in the conveying direction 48. According to the preferred embodiment, five pre-drying units 47 are present. Each pre-drying unit 47 extends perpendicular to the conveying direction 48, at least over the at least one printed region, preferably over the entire width of the endless third material web 36. The pre-drying units 47 face towards the at least one printed region or respectively the outer side 39 of the endless third material web 36 and arranged adjacent to it. They are arranged above the endless third material web 36. The individual pre-drying units 47 are favourably connected to one another in a hinged manner via hinges 49, of which the hinge axes extend perpendicular to the conveying direction 48.

Furthermore, each pre-drying unit 47 bears an air-supply pipe 50*a* and a waste-air pipe 50*b*. Each pre-drying unit 47 is constituted as an infrared (IR) spotlight unit for the transmission of infrared radiation.

Furthermore, the printed-region drying arrangement 40 has a guiding device 51 for guiding the endless third material web 36 within the printed-region drying arrangement 40. The guiding device 51 in turn has an upstream, first guiding unit 52, which is formed by several first guide rollers 53. The first guide rollers 53 extend parallel to one another and run perpendicular to the conveying direction 48. They are arranged below the endless third material web 36. The first guide rollers 53 are arranged at different heights relative to a base or respectively substructure. Starting from the input 41, the endless third material web 36 loses height during its conveying in the first guide unit 52 in the conveying direction 48. The first guiding unit 52 accordingly guides the endless third material web 36 from the input 41 diagonally downwards. In particular, the endless third material web 36 describes a convex guiding path with reference to an imaginary diagonal 54 which passes through the ends of the first guiding unit 52. Alternatively, for example, a concave guiding path is present. Alternatively, diagonal, discrete guiding regions with different inclinations relative to a horizontal are present in the first guiding unit 52. Accordingly, the pre-drying units 47 also have discrete positions, wherein the distance relative to the endless third material web 36 is favourably identical in each case.

The pre-drying device 45 can favourably be displaced, guided in its entirety along the, preferably substantially along the entire, first guiding unit 52 in and contrary to the conveying direction 48. For this purpose, a corresponding actuator 94, motor or similar is present. In a favourable manner, the pre-drying device 45 is constituted in the manner of a slide for this purpose.

The drying device 46 in turn has several drying units 55, which extend parallel to one another and run perpendicular to the conveying direction 48. Each drying unit 55 is constituted as a hot air drying unit for the generation and release of hot air.

The guiding device 51 has a second guiding unit 57 which adjoins the first guiding unit 52 downstream. The second guiding unit 57 is formed from several second guide rollers 58 which extend parallel to one another and perpendicular to the conveying direction 48. The second guide rollers 58 are arranged in such a manner that the endless third material web 36 extends substantially horizontally there. Considered more precisely, the endless third material web 36 extends in a convex manner relative to a horizontal 59 which passes through the ends of the second guide unit 47. This is achieved, in particular, by the second guide rollers 58. Adjacent second guide rollers 58 in each case span straight guide regions.

The drying units 55 are arranged at a substantially constant distance from the endless third material web 36 extending there, so that, overall, the latter also exhibits a convex curved course.

Between the guiding units 52, 57, an angle w is therefore present, which is disposed, between 20° and 60°, preferably between 30° and 50°.

In the following, the function of the printed-region drying arrangement 40 is described in greater detail with reference to its drying process.

The endless third material web 36 printed with at least one printed region enters the printed-region drying arrangement 40 via the input 41. The at least one printed region is still moist. Up to the input 41, the at least one printed region is substantially un-dried.

As shown in FIG. 3, the pre-drying device 45 is arranged adjacent to the input 41, so that the material-web intermediate conveying path 43 present between the digital printing device 37 and the pre-drying device 45 or respectively a conveying path without active drying is minimal.

The endless third material web 36 is disposed at the top in the printed-region drying arrangement 40 on the first guide rollers 53, so that the first guiding unit 52 guides the endless third, printed material web 36. The endless third material web 36 is guided below the pre-drying units 47, past the latter, which are arranged opposite to the guide rollers 53 and adjacent to the endless third material web 36.

The pre-drying units 47 emit infrared radiation. Each pre-drying unit 47 favourably comprises at least one infrared radiation source (not illustrated), which extends perpendicular to the conveying direction 48 of the adjacent endless third material web 36 or respectively is aligned perpendicular to the latter. The infrared radiation sources are constituted, in particular, as spotlights or respectively lamp. The transmitted infrared radiation strikes the at least one printed region or respectively the outer side 39 of the endless third material web 36. In this context, the temperature of the endless third material web 36 or respectively of the at least one printed region rises to 60° C. to 120° C. The thermal drying achieved as a result and the associated dehumidification of the at least one printed region leads to an abrupt rise in the colour viscosity of the at least one printed region. Accordingly, an excessive colour value increase or an excessive dot gain or respectively an excessive blotting of the at least one colour of the at least one printed region is prevented. As a result of air guided through the air inlet pipe 50*a* and the waste air pipe 50*b*, the pre-drying units 47 are effectively cooled during operation. The waste air with high atmospheric humidity is constantly transported away from the drying region by the negative pressure generated by a fan, which prevents a disturbing formation of condensate on cooler drying elements.

Following this, a full drying of the at least one printed region or respectively of the printing colour takes place in the drying device 46. The endless third material web 36 is guided between the drying units 55 and the second guide rollers 58. It is guided on the drying units 55 above the same and guided past, adjacent to the latter.

In this context, hot air from the drying units 55 is guided from below onto the outer side 39 or respectively the at least one printed region. The drying accordingly takes place through convection of the ambient air supplied, which provides a temperature between 80° C. and 150° C. The residual liquid ink components are accordingly extracted from the at least one printed region or respectively the colour layer. The convection effect is favourably reinforced by fast hot-air speeds greater than 30 m/s, ideally greater than 50 m/s. Following this, the endless third material web 36 leaves the printed-region drying arrangement 40 via the output 42. At least one air-supply pipe 62*a* and waste-air pipe 62*b* is associated with each drying unit 55, in order to supply and remove the hot air to and from the drying units 55.

Dependent upon the material-web conveying speed of the endless third material web 36, the drying units 47, guided together as a unit, are displaced, in or respectively contrary to the conveying direction 48.

In order to lengthen the material-web intermediate conveying path 43 or respectively to delay the start of drying of the printed endless third material web 36, the pre-drying device 45 is displaced starting from a first end position adjacent to the input 41, which is shown in FIG. 3, substantially away along the endless third material web 36.

Because of the hinged connection of the individual pre-drying units 47 to one another, the pre-drying device 45 is extremely flexible and accordingly capable of following a curved path in its displacement, which corresponds substantially to the course of the adjacent endless third material web 36.

FIG. 4 shows the second end position of the pre-drying device 45. The pre-drying device 45 is moved away from the input 41 or respectively arranged at a distance from the latter. The pre-drying device 45 is arranged adjacent to the drying device 46. The pre-drying device 45 is also capable of occupying intermediate positions between the end positions.

In particular, the pre-drying device 45 is moved away from the input 41 in the direction towards the drying device 46, when the endless third material web 36 is conveyed with increased conveying speed in the conveying direction 48. In particular, the pre-drying device 45 is moved in such a manner that the conveying time between the printing device 37 and the pre-drying device 45 of the endless third material web 36 is always the same with the same material web and printing. The material-web conveying speed of the endless third material web 36 is taken into consideration accordingly in an information-processing device 95. The material-web conveying speed of the endless third material web 36 can be detected, for example, via a corresponding speed measurement sensor. The information-processing device 95 outputs signals for the corresponding adjustment of the pre-drying device 45.

Conversely, the pre-drying device 45 is moved away from the drying device 46, especially in the direction towards the input 41, when the endless third material web 36 is conveyed with delayed conveying speed in the conveying direction 48. In particular, the pre-drying device 45 is moved in such a manner that the conveying time between the printing device 37 and the pre-drying device 45 of the endless third material web 36 is always the same with the same material web and printing.

It is advantageous if the drying power of the pre-drying device 45 can be further influenced in order to influence the start of drying of the at least one printed region. If the endless third material web 36 is conveyed with comparatively increased material-web conveying speed, it is preferable that, for example, the drying power of the pre-drying unit 47 arranged adjacent to the input 41 is at least reduced. The reduced drying power of this pre-drying unit 47 is favourably compensated by the subsequent pre-drying units 47. If the endless third material web 36 is conveyed with comparatively reduced material-web conveying speed, it is preferable that, for example, the drying power of the pre-drying unit 47 arranged adjacent to the input 41 is increased. The increased drying power of this pre-drying unit 47 is favourably compensated by the subsequent pre-drying units 47.

A pre-heating device 66, which comprises two pre-heating rollers 67 arranged one above the other is disposed downstream of the storage unit 29 and the printed-region drying arrangement 40. The first corrugated-board web 22 laminated on one side and the endless third printed and dried material web 36 are supplied to the pre-heating device 66, which both partially surround the respective pre-heating roller 67.

A gluing unit 68 with a gluing roller 69, which is partially immersed in a glue bath, is arranged downstream of the pre-heating device 66. The corrugated-board web 22 laminated on one side is disposed in contact with the gluing roller 69 and is accordingly provided with glue from the glue bath.

A hot-pressing device 70 which comprises a horizontally extending heated table 71 with heating plates 72 is arranged downstream of the gluing unit 68. A pressing belt 74 guided via guide rollers 73 is arranged adjacent to the heated table 71. Between the pressing belt 74 and the heated table 71, a pressing gap is constituted, through which the glued corrugated-board web 22 laminated on one side and the endless third, printed material web 36 are guided. An endless corrugated-board web 75 laminated on both sides, which is printed on the outer side, is present downstream of the hot pressing device 70.

A creasing device 76 and a longitudinal cutting device 77 are arranged downstream of the hot pressing device 70. The creasing device 76 and the longitudinal cutting device 77 are constituted in an integrated manner as longitudinal cutting/creasing device 77, 76. The creasing device 76 comprises a first creasing unit 78 and a second creasing unit 79. The creasing units 78, 79 each have two tool beds which are arranged substantially in mirror-image symmetry relative to the corrugated-board web 75. The tool beds can be pivoted, so that creasing tools can be brought individually into engagement with the corrugated-board web 75 in order to crease the same.

The longitudinal cutting device 77 comprises a first longitudinal cutting unit 80 and a second longitudinal cutting unit 81. For the longitudinal cutting of the corrugated-board web 75, the longitudinal cutting units 80, 81 comprise cutting tools, which are arranged on tool carriers and can be brought individually into cutting engagement with the corrugated-board web 75 and can be individually displaced transversely to the conveying direction 48. The longitudinal cutting device 77 serves for the longitudinal cutting of the corrugated-board web 75 into several corrugated-board sub-webs 82, 83, 84.

A transverse cutting device 85 is arranged downstream of the longitudinal cutting device 77. The transverse cutting device 85 comprises a blade-carrying roller 86 capable of rotary actuation, which extends over the entire width of the web. Several support units 87 are arranged side-by-side perpendicular to the conveying direction 48 opposite to the blade-carrying roller 86. The support units 87 are each connected to a piston-cylinder unit, so that the support units 87 is displaceable individually along the conveying direction 48. The transverse cutting device 85 serves for the partial transverse cutting of the corrugated-board web 75 in the case of a change of format.

A distributing guide 88, which serves for the subdivision of the corrugated-board sub-webs 82, 83, 84 into three levels, is arranged downstream of the transverse cutting device 85.

Further transverse cutting devices 89 for the transverse cutting of the corrugated-board sub-webs 82, 83, 84 to form corrugated-board sheets 90 are arranged downstream of the distributing guide 88.

The individual printed, corrugated-board sheets 90 are stacked on one another in stacking devices 91, 92 and respectively 93.

In the following, a second embodiment of the printed-region drying arrangement 40 is described with reference to FIG. 5. Reference is made to the previous embodiment. Components of identical design are given the same reference numbers as in the case of the previous embodiment, to the description of which reference is accordingly made. Components of different design but similar function are given the same reference numbers with the suffix "a".

By contrast with the previous embodiment, the printed-region drying arrangement 40*a* has a first guiding unit 52*a* with guide rollers 53. Endless guiding means 60, such as belts, strips, chains or similar are guided in each case around to guide rollers 53 arranged adjacent to one another. It is advantageous if at least one of the guide rollers 53 can be driven and/or braked. It is expedient if the guide rollers 53 are synchronised directly or indirectly with one another via the guiding means 60, so that the guide rollers 53 run concurrently and without slip. According to one preferred embodiment, the guide rollers 53 can be driven actively via actuator units. The guiding means 60 are preferably driven and/or braked in such a manner that, at least in the printed-region drying arrangement 40*a*, a free suspension of the endless third material web 36 is prevented. In this manner, a distortion of the web can be minimised. A support plate (not illustrated) is also favourably arranged between each guiding unit, which ensures a further support of the endless third printed material web 36.

Figure 5:
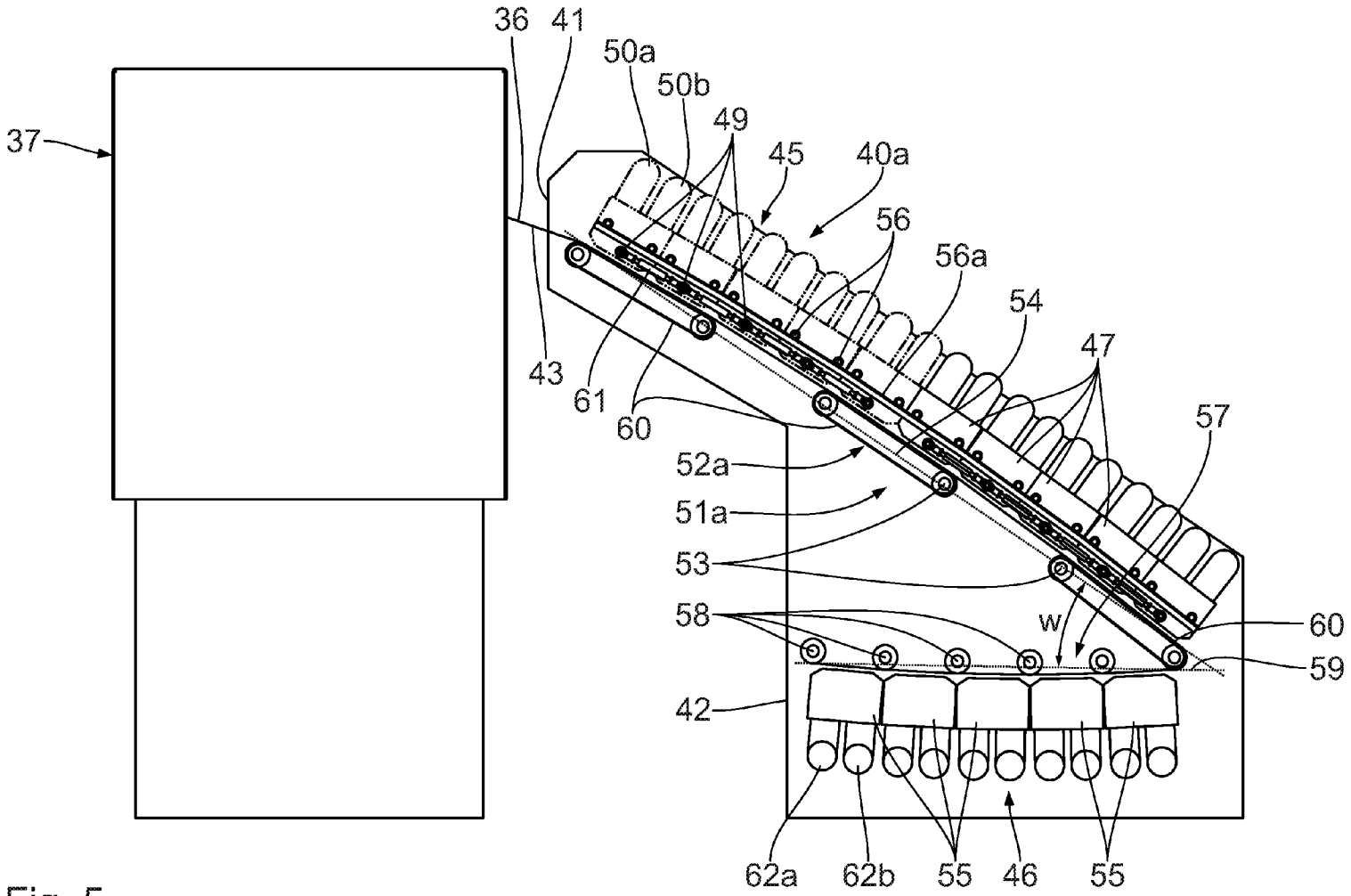
FIG. 5 shows a lateral view in which, alongside a printing device, an alternative printed-region drying arrangement according to a second embodiment is illustrated.

The hinged connection of the pre-drying units 47 via the hinges 49 is clearly evident from FIG. 5. The pre-drying units 47 are coupled with one another via lower connecting rods 61, which extend in the conveying direction 48 of the adjacent endless third material web 36. The connecting rods 61 are each connected adjacent to the endless third material web 36 in the respective pre-drying unit 47, centrally with reference to its extension along the conveying direction 48. The hinge axes extend perpendicular to the conveying direction 48. Above the connecting rods 61, each pre-drying unit 47 bears at least two running rollers 56, which roll on an uneven running track 56*a* following the uneven course of the adjacent endless third material web 36.

Figure 6:
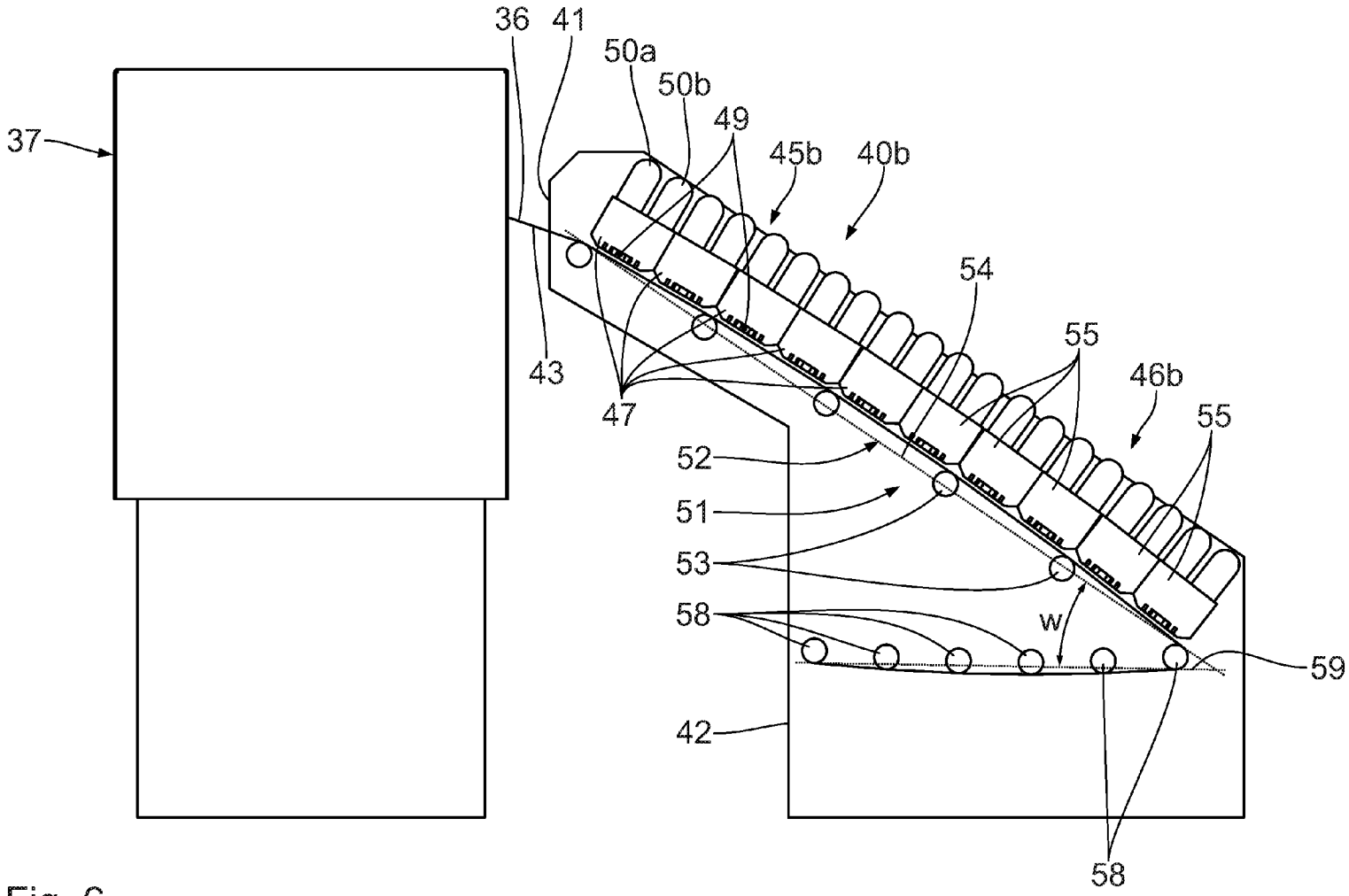
FIG. 6 shows a lateral view in which, alongside a printing device, an alternative printed-region drying arrangement according to a third embodiment is illustrated.

In the following, a third embodiment of the printed-region drying arrangement 40 is described with reference to FIG. 6. Identical components have been given the same reference numbers. Parts of different design but similar function are given the same reference numbers with the suffix "b".

By contrast with the previous embodiment, the entire printed-region drying arrangement 40*b* can be moved in such a manner that the material-web intermediate conveying path 43 is varied. In this context, the pre-drying device 45*b* is preferably immovable relative to the drying device 46*b*. By preference, the pre-drying device 45*b* and the drying device 46*b* are combined to form a unit and favourably extend over the entire length of the first guiding unit 52.

Figure 7:
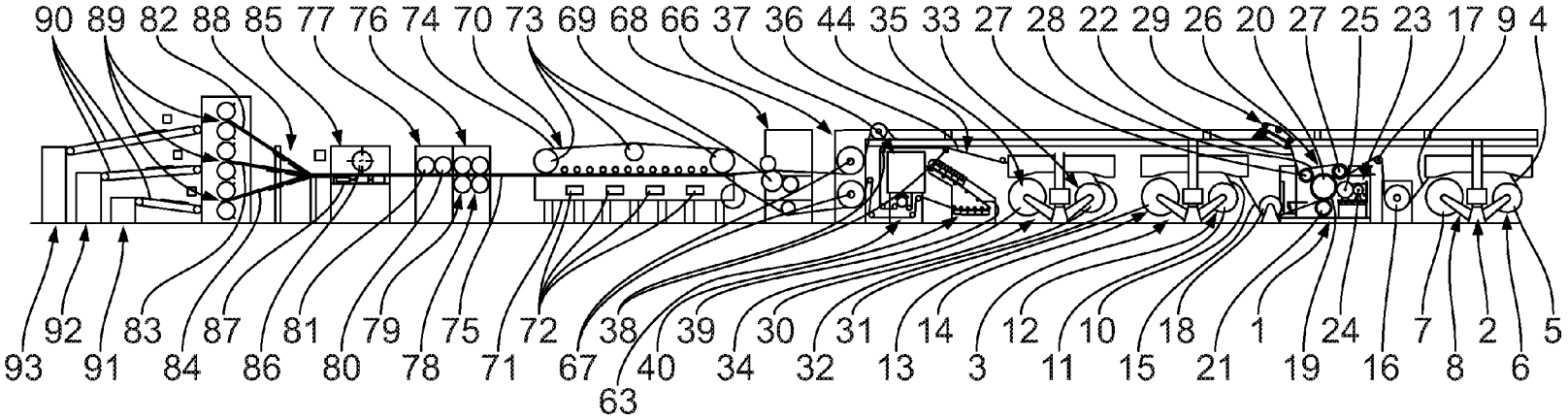
FIG. 7 shows a lateral view of a corrugated-board machine according to the invention according to a further embodiment.

In the following, a further embodiment of the corrugated-board machine is described with reference to FIG. 7.

Figure 8:
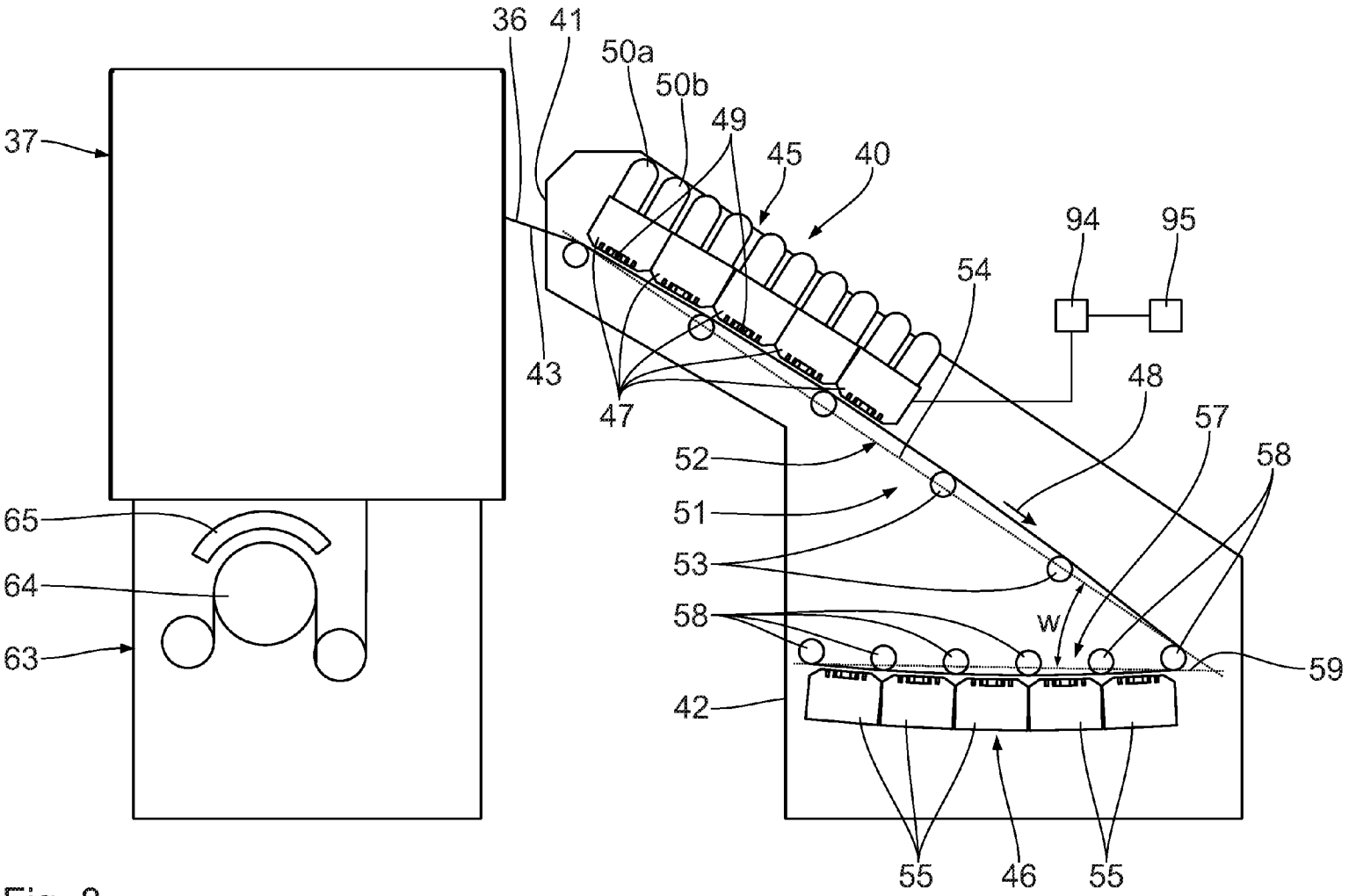
FIG. 8 shows a lateral view which also shows a corona pre-treatment device illustrated in FIG. 7.

By contrast with the first embodiment, a corona pre-treatment device 63 is arranged adjacent to the digital printing device 37 and upstream of the latter. The corona pre-treatment device 63, which is shown in detail in FIG. 8, comprises a corona-bearing roller 64 and at least one electrode 65 arranged adjacent to the latter. The endless third material web 36 is guided around the corona-bearing roller 64. Here, the endless third material web 36 runs through a gap which is formed by the corona-bearing roller 64 and the at least one electrode 65.

Through the corona pre-treatment device 63, the outer side 39 of the endless third material web 36 to be printed is exposed to an electrical corona discharge, which leads to an oxidation of its surface. This is implemented especially in the case of a treated endless third material web 36. This results in higher dot gains in a colour application or respectively a printing. The adhesion of the printing colour is additionally improved in this manner.

Figure 9:
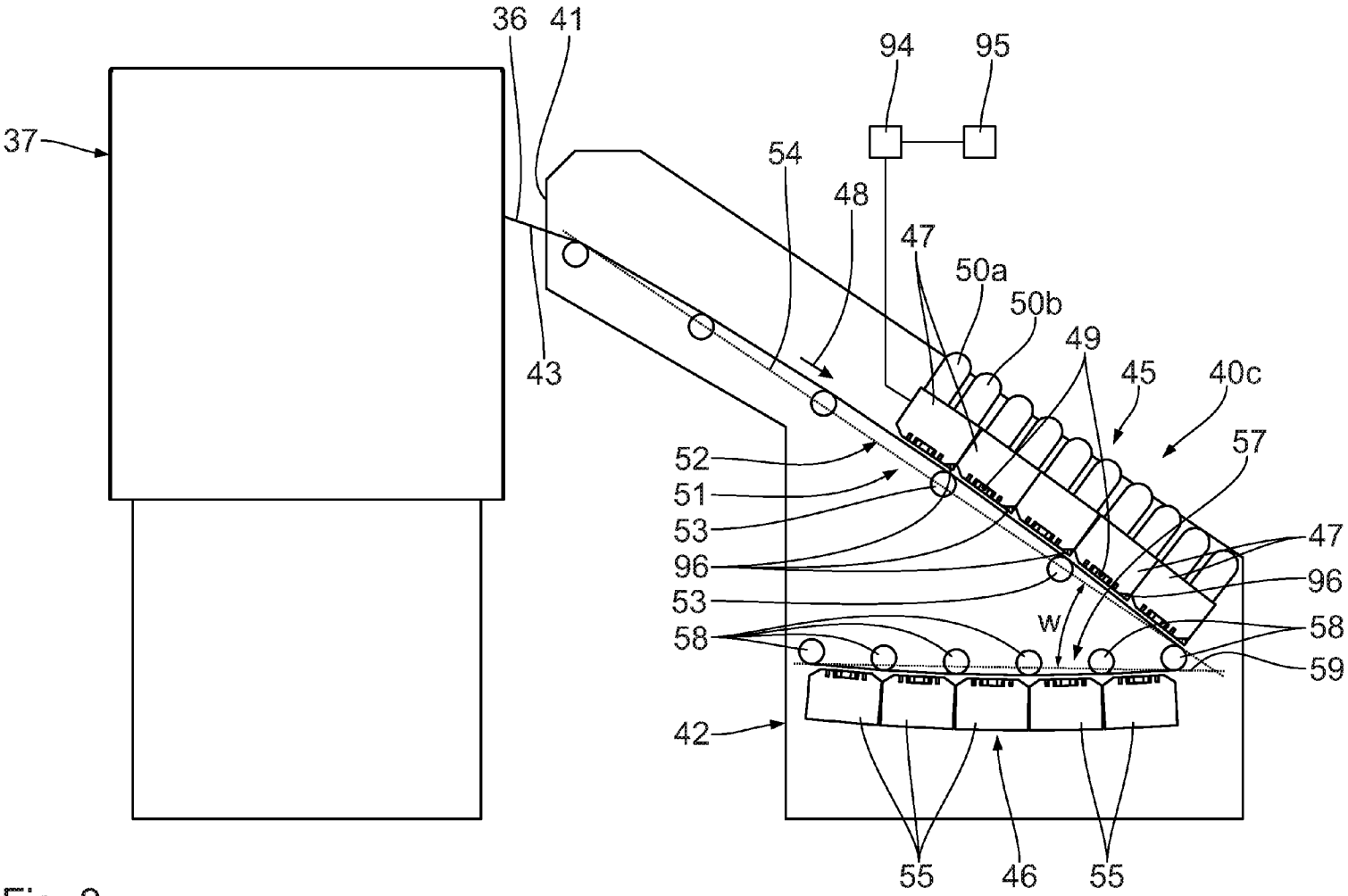
FIG. 9 shows a lateral view in which, alongside a printing device, an alternative printed-region drying according to a fourth embodiment is illustrated.

In the following, a fourth embodiment of the printed-region drying arrangement is described with reference to FIG. 9. Identical components have been given the same reference numbers. Parts of different design but similar function are given the same reference numbers with the suffix "c".

By contrast with the printed-region drying arrangement described above, the printed-region drying arrangement 40*c* has a plurality of temperature measurement sensors 96. The temperature measurement sensors 96 are arranged adjacent to an upper side of the printed material web 36 to measure the temperature predominating there at the material web 36. They measure, substantially between the pre-drying units 47, the temperature of the printed material web 36 running there. Favourably, each pre-drying unit 47 is provided, at its outlet side in relation to the conveying direction of the material web 36, with at least one temperature measurement sensor 96.

The temperature measurement sensors 96 are in signal connection with the information processing device 95. The information processing device 95 thus receives the corresponding temperature signals from the temperature measurement sensors 96, said signals representing the detected temperature predominating there of the printed material web 36. If necessary, the information processing device 95 actuates at least one of the pre-drying units 47 or the pre-drying unit 45 in its entirety to adapt the drying process of the material web 36 accordingly or, respectively, to reduce deviations from a desired temperature.

Mutual combinations of the individual embodiments are possible.

What is claimed is:

1. A corrugated-board unit for manufacturing corrugated board, the corrugated-board unit comprising:
   - a material-web output device for outputting a material web;
   - a conveying device for conveying the material web along a material-web conveying path;
   - a printing device, disposed downstream of the material-web output device, for producing at least one printed region on the material web;
   - a printed-region drying arrangement, disposed downstream of the printing device, for drying the at least one printed region; and
   - a connecting device, disposed downstream of the printed-region drying arrangement, for connecting the printed, dried material web to at least one further material web to produce a printed corrugated web, wherein a start of drying of the at least one printed region applied to the material web is influenced by the printed-region drying arrangement, wherein an information processing device varies the start of drying of the at least one printed region applied to the material web based on a material-web conveying speed of the material web, the start of drying of the at least one printed region applied to the material web through the printed-region drying arrangement being controlled by at least varying a distance between the printing device and the printed-region drying arrangement.

2. A corrugated-board unit according to claim 1, wherein the printed-region drying arrangement comprises a first drying device, especially a pre-drying device, for at least partially drying the at least one printed region on the material web, wherein the first drying device comprises at least one first drying unit.

3. A corrugated-board unit according to claim 2, wherein the first drying device is displaceable along the printed material web.

4. A corrugated-board unit according to claim 2, wherein several first drying units are provided, wherein the first drying units are arranged adjacent to one another along the material-web conveying path for drying the at least one printed region.

5. A corrugated-board unit according to claim 4, wherein the first drying units are connected to one another in a hinged manner for arrangement adjacent to the material web.

6. A corrugated-board unit according to claim 4, wherein temperature measurement sensors are associated to the first drying units for measuring the temperature predominating there at the material web.

7. A corrugated-board unit according to claim 2, wherein the printed-region drying unit comprises a second drying device arranged downstream of the first drying device for at least partially drying the at least one printed region on the material web, wherein the second drying device comprises at least one second drying unit, which differs from the at least one first drying unit in its manner of functioning.

8. A corrugated-board unit according to claim 1, wherein the information-processing device receives temperature signals from temperature measurement sensors and activates at least one of the group comprising the first drying units and the first drying device in its entirety correspondingly.

9. A corrugated-board unit according to claim 1, wherein the printed-region drying arrangement comprises a guiding device for guiding the material web.

10. A corrugated-board machine according to claim 9, wherein the guiding device comprises a first guiding unit inclined relative to a horizontal.

11. A method for manufacturing corrugated board, the method comprising the following steps:
   - output of a material web from a material-web output device;
   - producing at least one printed region on the material web by means of a printing device;
   - drying of the at least one printed region by a printed-region drying arrangement;
   - influencing a start of drying of the at least one printed region applied to the material web by the printed-region drying arrangement;
   - connecting of the printed and dried material web to at least one further material web in a connecting device in order to produce a printed corrugated-board web;
   - varying the start of drying of the at least one printed region applied to the material web dependent upon a material-web conveying speed of the material web by an information processing device; and
   - influencing the start of drying of the at least one printed region applied to the material web through the printed-region drying arrangement by varying a distance between the printing device and the printed-region drying arrangement.

12. A corrugated-board unit for manufacturing corrugated board, the corrugated-board unit comprising:
   - a material-web output device for outputting a material web;
   - a conveying device for conveying the material web along a material-web conveying path;
   - a printing device, disposed downstream of the material-web output device, for producing at least one printed region on the material web;
   - a printed-region drying arrangement, disposed downstream of the printing device, for drying the at least one printed region; and
   - a connecting device, disposed downstream of the printed-region drying arrangement, for connecting the printed, dried material web to at least one further material web to produce a printed corrugated web, wherein a start of drying of the at least one printed region applied to the material web is influenced by the printed-region drying arrangement, wherein an information processing device varies the start of drying of the at least one printed region applied to the material web based on a material-web conveying speed of the material web, the start of drying of the at least one printed region applied to the material web through the printed-region drying arrangement is being controlled by varying a partial conveying path traveled by the material web between the printing device and the printed-region drying arrangement.

13. A method for manufacturing corrugated board, the method comprising the following steps:
   - output of a material web from a material-web output device;
   - producing at least one printed region on the material web by means of a printing device;
   - drying of the at least one printed region by a printed-region drying arrangement;
   - influencing a start of drying of the at least one printed region applied to the material web by the printed-region drying arrangement;

connecting of the printed and dried material web to at least one further material web in a connecting device in order to produce a printed corrugated-board web;

varying the start of drying of the at least one printed region applied to the material web dependent upon a material-web conveying speed of the material web by an information processing device, and controlling the start of drying of the at least one printed region applied to the material web through the printed-region drying arrangement by varying a partial conveying path traveled by the material web between the printing device and the printed-region drying arrangement.

14. A corrugated-board unit for manufacturing corrugated board, the corrugated-board unit comprising:

a material-web output device for outputting a material web;

a conveying device for conveying the material web along a material-web conveying path;

a printing device, disposed downstream of the material-web output device, for producing at least one printed region on the material web;

a printed-region drying arrangement, disposed downstream of the printing device, for drying the at least one printed region; and a connecting device, disposed downstream of the printed-region drying arrangement, for connecting the printed, dried material web to at least one further material web to produce a printed corrugated web, wherein a start of drying of the at least one printed region applied to the material web is influenced by the printed-region drying arrangement, wherein an information processing device varies the start of drying of the at least one printed region applied to the material web based on a material-web conveying speed of the material web, the start of drying of the at least one printed region applied to the material web through the printed-region drying arrangement being controlled by varying a drying power of the printed-region drying arrangement.

15. A corrugated-board unit according to claim 14, wherein the printed-region drying arrangement comprises a first drying device, especially a pre-drying device, for at least partially drying the at least one printed region on the material web, wherein the first drying device comprises several first drying units, wherein the first drying units are arranged adjacent to one another along the material-web conveying path for drying the at least one printed region.

16. A corrugated-board unit according to claim 15, wherein a variation of a drying power of at least one first drying unit arranged upstream leads to a compensation by at least one succeeding drying unit.

17. A corrugated-board unit according to claim 15, wherein a reduction of a drying power of at least one first drying unit arranged upstream leads to an increase of the drying power of the at least one first drying unit disposed downstream of the former.

18. A corrugated-board unit according to claim 15, wherein a fine adjustment of the printed-region progression time is possible through at least partial transfer of a drying power between the individual first drying units.

19. A corrugated-board unit according to claim 15, wherein an increase of an output of at least one first drying unit and simultaneous reduction of an output of at least one further first drying unit, which, with reference to the first drying unit of increased output, comprises a reduced conveying distance relative to the printing device to provide a shortening of a printed-region progression time.

20. A corrugated-board unit according to claim 15, wherein an increase of a drying power of the first drying unit arranged adjacent to an entrance of the printed-region drying arrangement is provided, when the material web is conveyed with comparatively reduced material-web conveying speed.

21. A method for manufacturing corrugated board, the method comprising the following steps:

output of a material web from a material-web output device;

producing at least one printed region on the material web by means of a printing device;

drying of the at least one printed region by a printed-region drying arrangement;

influencing a start of drying of the at least one printed region applied to the material web by the printed-region drying arrangement;

connecting of the printed and dried material web to at least one further material web in a connecting device in order to produce a printed corrugated-board web;

varying the start of drying of the at least one printed region applied to the material web dependent upon a material-web conveying speed of the material web by an information processing device, and controlling the start of drying of the at least one printed region applied to the material web through the printed-region drying arrangement by varying a drying power of the printed-region drying arrangement.

* * * * *